US010753118B2

(12) United States Patent
Vesper

(10) Patent No.: US 10,753,118 B2
(45) Date of Patent: Aug. 25, 2020

(54) PORTABLE SHELTER WITH VESTIBULE ADAPTER AND CONCENTRIC FLEXIBLE CONNECTOR

(71) Applicant: Alaska Structures, Inc., Kirkland, WA (US)

(72) Inventor: Michael Vesper, Anchorage, AK (US)

(73) Assignee: Alaska Structures, Inc., Kirkland, WA (US)

( * ) Notice: Subject to any disclaimer, the term of this patent is extended or adjusted under 35 U.S.C. 154(b) by 0 days.

(21) Appl. No.: 16/029,959

(22) Filed: Jul. 9, 2018

(65) Prior Publication Data

US 2019/0017288 A1 Jan. 17, 2019

Related U.S. Application Data

(60) Provisional application No. 62/589,116, filed on Nov. 21, 2017, provisional application No. 62/532,165, filed on Jul. 13, 2017.

(51) Int. Cl.

| | |
|---|---|
| ***E04H 15/18*** | (2006.01) |
| ***E04H 15/58*** | (2006.01) |
| ***E04H 15/32*** | (2006.01) |
| ***E04H 15/54*** | (2006.01) |

(52) U.S. Cl.

CPC ..... *E04H 15/18* (2013.01); *E04H 15/32* (2013.01); *E04H 15/54* (2013.01); *E04H 15/58* (2013.01)

(58) Field of Classification Search

CPC ..... E04H 15/18; E04H 15/54

See application file for complete search history.

(56) References Cited

U.S. PATENT DOCUMENTS

| | | | | | |
|---|---|---|---|---|---|
| 1,820,412 | A * | 8/1931 | Warren | E04H 15/18 | 135/116 |
| 2,939,467 | A * | 6/1960 | Meyer | E04H 15/22 | 52/2.13 |
| 3,965,915 | A * | 6/1976 | Kirkham | E04H 15/18 | 135/97 |
| 4,886,084 | A * | 12/1989 | Lawrence | E04H 15/18 | 135/124 |
| 4,979,532 | A * | 12/1990 | Johansson | E04H 15/64 | 135/97 |
| 5,222,513 | A * | 6/1993 | Hilliard | E04H 15/18 | 135/117 |

(Continued)

FOREIGN PATENT DOCUMENTS

| | | | | |
|---|---|---|---|---|
| FR | 2519055 A1 * | 7/1983 | ..... | E04H 1/1205 |
| WO | WO-2014076384 A1 * | 5/2014 | ..... | E04H 15/18 |

OTHER PUBLICATIONS

English translation of WO 2014/076384 A1 from espacenet.com.*

*Primary Examiner* — David R Dunn
*Assistant Examiner* — Danielle Jackson
(74) *Attorney, Agent, or Firm* — Blank Rome LLP

(57) ABSTRACT

A portable shelter is provided with a flexible vestibule adapter and a flexible connector connected to the same wall, concentrically surrounding a door. Individual shelter elements may be deployed for functionally different end uses and are protected from weathering and damage when not in use, and the stored elements do not get in the way of other end uses. For example, the vestibule adapter and the flexible connector may be rolled up on themselves for storage individually or together, depending on the desired end-use configuration.

9 Claims, 3 Drawing Sheets

(56) References Cited

U.S. PATENT DOCUMENTS

| | | | | |
|---|---|---|---|---|
| 5,394,897 | A * | 3/1995 | Ritchey | E04H 15/18 135/117 |
| 6,145,525 | A * | 11/2000 | Mooney | E04H 5/02 135/119 |
| 6,273,114 | B1 * | 8/2001 | Schaefer | E04H 15/18 135/128 |
| 9,470,010 | B2 * | 10/2016 | Youn | E04H 15/64 |
| 2004/0238021 | A1 * | 12/2004 | Holub | E04H 15/18 135/97 |
| 2005/0189009 | A1 * | 9/2005 | Walter | E04H 15/001 135/97 |
| 2009/0110911 | A1 * | 4/2009 | Van Halderen | B32B 27/12 428/332 |
| 2013/0333737 | A1 * | 12/2013 | Williams | E04H 15/18 135/97 |
| 2017/0058556 | A1 * | 3/2017 | Lilly, II | E04H 15/54 |
| 2017/0089092 | A1 * | 3/2017 | Krenzel | E04H 15/18 |
| 2017/0234026 | A1 * | 8/2017 | LaHood | E04H 15/18 135/97 |

* cited by examiner

PORTABLE SHELTER WITH VESTIBULE ADAPTER AND CONCENTRIC FLEXIBLE CONNECTOR

CROSS-REFERENCE TO RELATED APPLICATION

This application claims the benefit of U.S. Provisional Application Nos. 62/589,116, filed Nov. 21, 2017; and 62/532,165, filed Jul. 13, 2017, the disclosures of which are incorporated by reference in their entireties herein.

BACKGROUND

The present invention relates to one or more portable structures of the type used to provide shelter for people and/or equipment. The shelters may be formed at least partially of flexible material, for example, fabric. The present invention is especially well-adapted for use in remote and rugged locations where it is difficult and/or time-consuming to configure one or more shelters for particular end uses, and in situations where flexibility of use, convenience, durability, and/or ease of set-up and storage are desirable. However, the present invention provides important advantages over the prior art in other conditions and situations as well.

SUMMARY

According to one, non-limiting, aspect of the present invention, a portable shelter may be provided with a flexible wall, for example at an end of the portable shelter, and a door may be located within the wall. A flexible vestibule adapter and a flexible connector may be connected to the same wall, surrounding the door. According to a preferred embodiment of the present invention, the flexible vestibule adapter, the flexible connector, and the door may all be located within the same plane, and the vestibule adapter may be concentrically located within the flexible connector.

According to another aspect of the present invention, a weather-resistant seam may be used to connect the vestibule adapter to the wall, and another weather-resistant seam may be used to connect the flexible connector to the wall. Advantageously, the first seam may be concentrically located within the second seam. Compared to the prior art, the present invention can be used much more conveniently and flexibly, and with different equipment and features, for various end uses.

In particular, the portable shelters may be operated in various configurations, and not just the ones described herein. For example, in a first storage configuration, the flexible connector can cover the vestibule adapter while the flexible connector and the vestibule adapter are both stored close to the wall. In a second, different configuration, the vestibule connector can be in an unfurled or extended condition to overlap an end of a vestibule frame while the flexible connector is stored close to the wall. In a third, different configuration the vestibule connector can be, if desired, stored close to the wall while the flexible connector is unfurled or extended to connect one portable shelter to another.

If desired, the flexible connector may be used, together with a suitable frame, to connect a portable shelter, end-to-end, to another portable shelter, so that people and equipment can move between facing doors of the two shelters without being exposed to weather (i.e., without being exposed to the environment outside the shelters). If desired, the vestibule adapter may be used separately to connect the portable shelter to a suitable vestibule. In each end-use configuration, the element or elements that are not being used may be conveniently secured in a respective storage position.

As a result of the improvements described herein, the individual elements of the portable shelter make it possible for the shelter to be used in multiple ways, and yet the individual elements are protected from weathering and damage when not in use, and the stored elements do not get in the way of other end uses. For example, the vestibule adapter and the flexible connector may be rolled up on themselves for storage individually or integrally together, depending on the desired end-use configuration.

If desired, a connector arch may be used to support the flexible connector when two portable shelters are connected end to end. If desired, the connector arch may have upwardly extending pins for connecting to grommets that are sewn into the flexible connector. If desired, the flexible connector may be sealed to the end wall of the portable shelter, in the desired configuration, in a weather-resistant fashion, using becket laces, hook and loop fasteners, and/or other suitable devices.

Further, if desired, and as described in more detail below, the vestibule adapter may have a rope threaded through a forward edge and across cut-out portions of the forward edge. The rope may be used to tighten the vestibule adapter to a vestibule frame. At the same time, the cut-out portions may be used to receive end portions of the vestibule frame near the wall of the portable structure, to establish a secure and weather-resistant structure.

DETAILED DESCRIPTION

Figure 2:
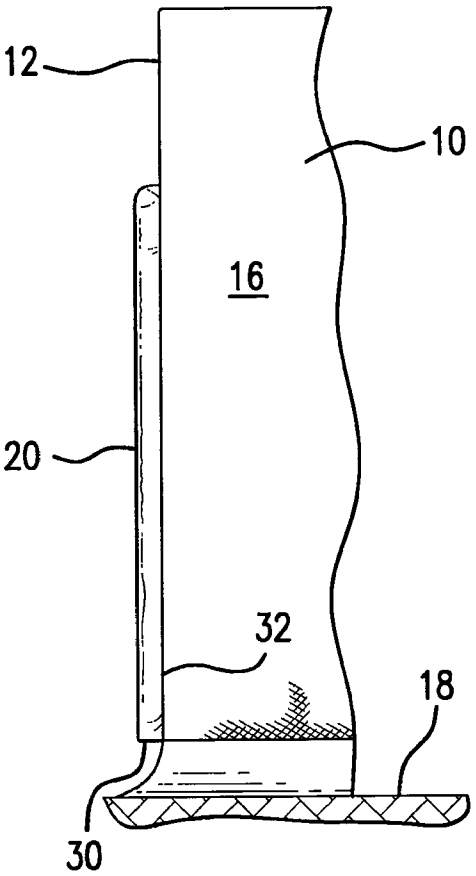
FIG. 2 is a partial side view of the shelter of FIG. 1.
Figure 1:
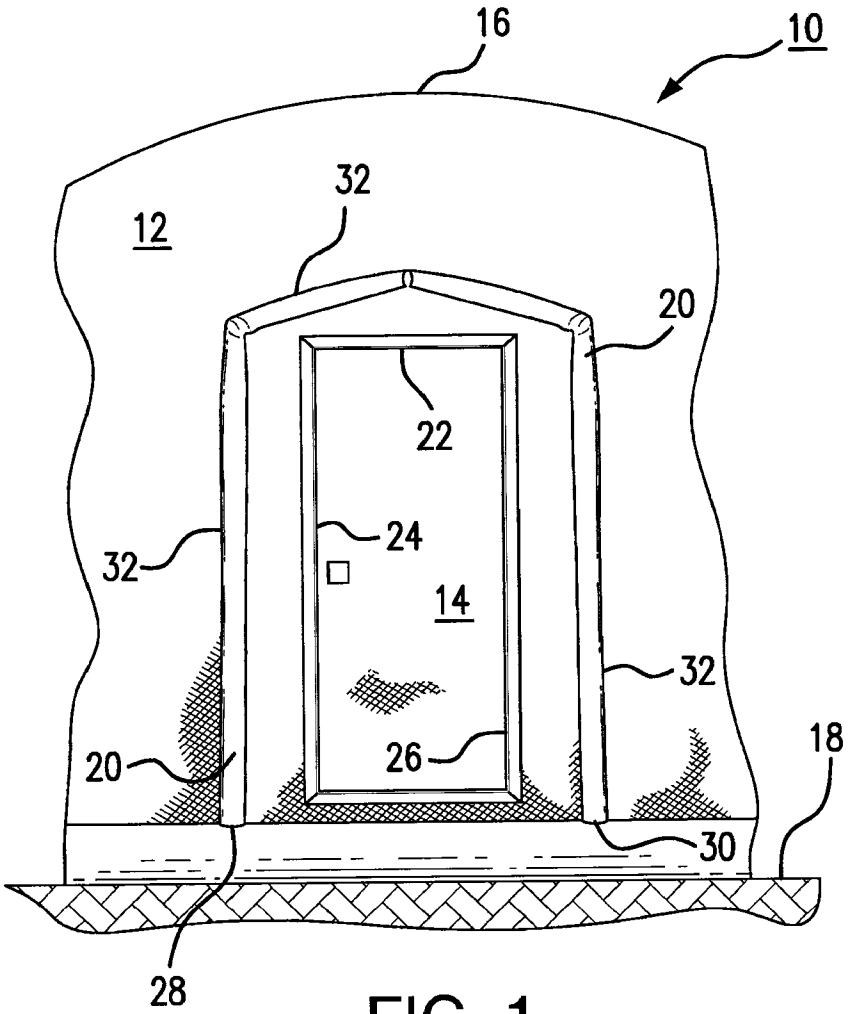
FIG. 1 is a partial end view of a flexible shelter constructed in accordance with an exemplary embodiment of the invention.

Referring now to the drawings, where like reference numerals designate like elements, there is shown in FIG. 1 a flexible, fabric shelter 10 constructed in accordance with one example of the present invention. The shelter 10 may be, for example, a TEMPER (Tent, Extendable, Modular, PERsonnel) structure with a flexible end panel 12, a solid or flexible door 14, and a flexible cover 16 (FIG. 2).

The flexible shelter 10 may have various other elements which are not shown in the drawings, such as, for example, windows, a ventilation duct, and a floor. The end panel 12 and the cover 16 may be supported above the ground 18 by a suitable frame (not visible in the example shown in the drawings, where the frame is located within the shelter). In any event, the present invention should not be limited to the specific structures and instrumentalities that are illustrated in the drawings. The scope of the present invention should be determined according to the claims which are numbered and located at the end of this specification.

Returning now to FIG. 1, the flexible shelter 10 illustrated therein has a flexible, fabric connector 20 which surrounds the top 22 and left and right sides 24, 26 of the door 14. Although the bottom ends 28, 30 of the flexible connector 20 may reach the ground 18, they do not, in the illustrated embodiment, go underneath the door 14. The flexible connector 20 is connected to the end panel 12 by a suitable weather-resistant seam 32, which may be a fabric-to-fabric seam, and which extends all the way around the top 22 and sides 24, 26 of the door 14. In the FIGS. 1 and 2 configuration, the connector 20 is rolled up on itself and held in a secure, storage position by suitable hook and loop fasteners (not illustrated), tie ropes, and/or other suitable devices.

Figure 4:
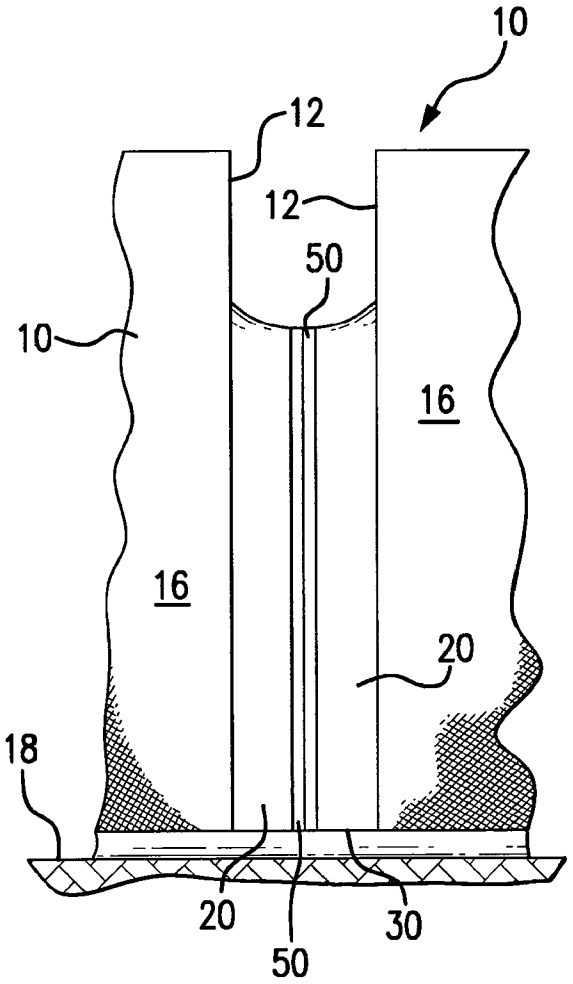
FIG. 4 is a partial side view of the combination of structures illustrated in FIG. 3, with the connector arch of FIG. 3 connected to a connector arch of another flexible structure, such as another tent.
Figure 3:
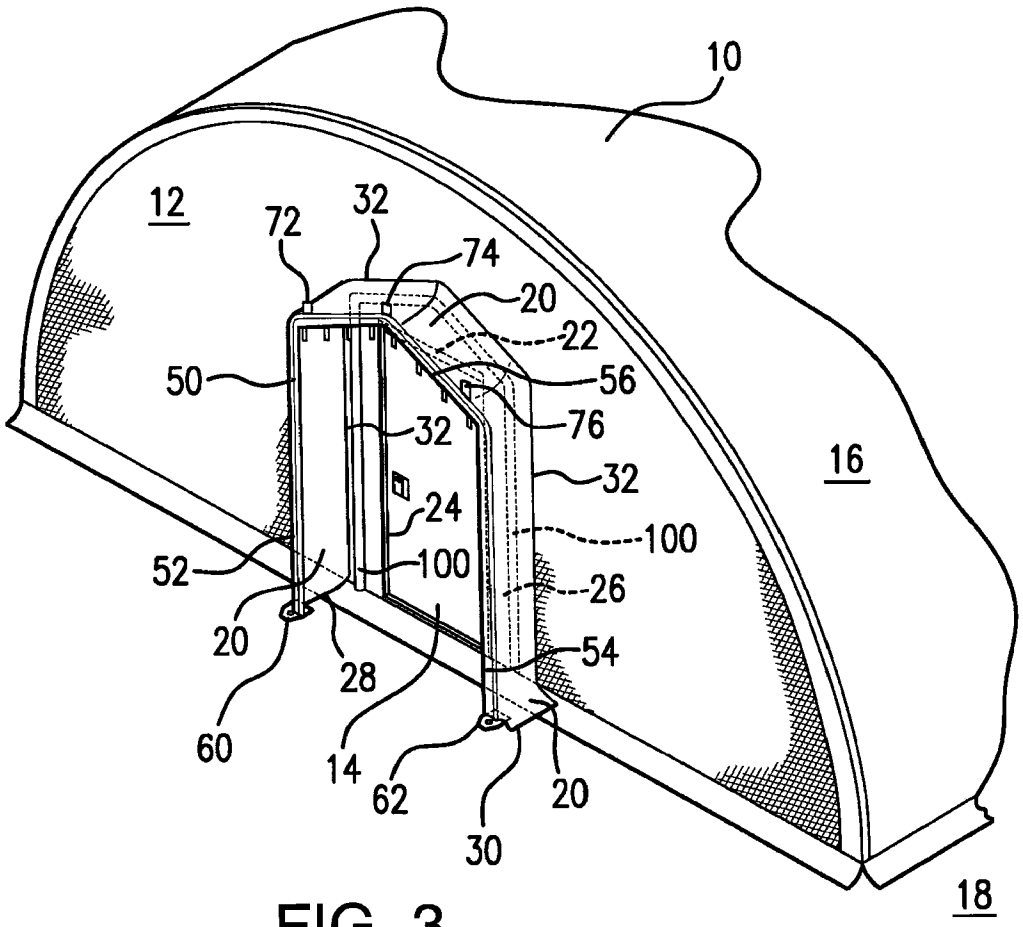
FIG. 3 is a partial perspective view of the flexible shelter of FIG. 1, with a flexible connector unfurled and connected to a connector arch.

Referring now to FIG. 3, the flexible connector 20 may be unfurled (i.e. released or untied from its storage configuration), extended, and connected to a rigid connector arch 50. In operation, as illustrated in FIG. 4, the connector arch 50 may be connected to another connector arch 50 of another flexible structure 10, so that the two flexible structures 10, 10 are connected to each other end-to-end in a weather-resistant fashion. If desired, personnel may walk from one structure 10 to the other structure 10 through doors 14 (not visible in FIG. 4), aligned flexible connectors 20, 20, and arches 50, 50 without being exposed to the weather.

Returning now to FIG. 3, in the illustrated embodiment, the connector arch 50 may have vertical upright sections 52, 54 rigidly connected to each other by an arch portion 56. Lower ends of the upright sections 52, 54 may be supported on respective base portions 60, 62. Stakes (not shown) may be driven through openings in the base portions 60, 62 to prevent the connector arch 50 from being dislodged by wind, etc. In addition, the arch portion 56 may have, for example, three pegs 72, 74, 76 which receive corresponding grommets sewn into the flexible connector 20. After the grommets are inserted over the pegs 72, 74, 76, the connection of the flexible connector 20 to the arch 50 may be completed in a weather-resistant fashion by becket laces and/or hook and loop fasteners.

Unfurling the flexible connector 20 reveals a vestibule adapter 100, as can be seen in FIG. 3. In the FIGS. 1 and 2 configuration, the flexible connector 20 completely, or almost completely, covers the vestibule adapter 100. In the FIGS. 1 and 2 configuration, and in the FIGS. 3 and 4 configuration, the vestibule adapter 100 is rolled up onto itself in a secure, stored position, and is held in that position by hook and loop fasteners, rope ties, or other suitable devices. Moreover, the vestibule adapter 100 is located concentrically between the flexible connector 20 and the door 14.

Figure 5:
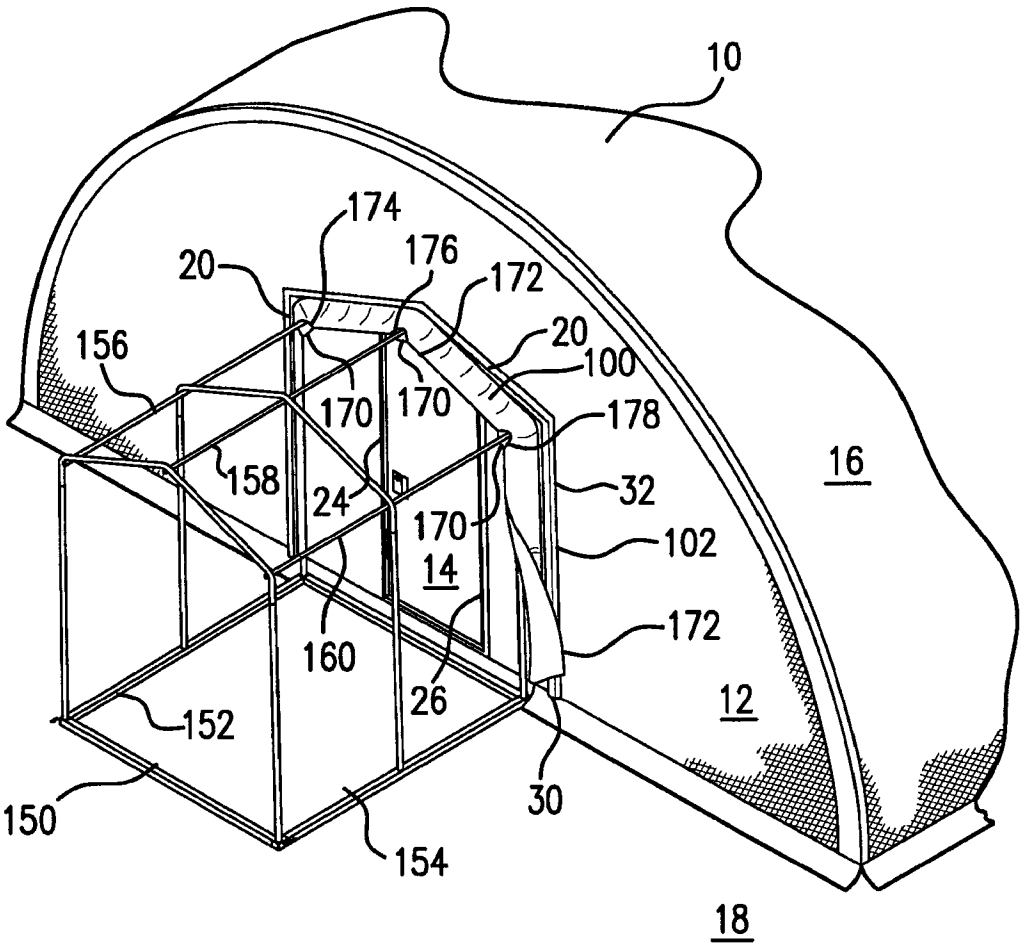
FIG. 5 is a partial perspective view of the flexible shelter of FIG. 1, with the flexible connector in a stored configuration, and with a vestibule adapter unfurled and extended over the end of a vestibule frame.

Like the flexible connector 20, the vestibule adapter 100 (shown in a rolled-up configuration in FIG. 3) extends from the ground 18 on both sides 24, 26 and over the top 22 of the door 14, without being located underneath the door 14. Referring now to FIG. 5, the vestibule adapter 100 is connected to the end panel 12 by a suitable weather-resistant seam 102 which extends continuously on both sides 24, 26 and over the top 22 of the door 14. The weather-resistant seam 102 of the vestibule adapter 100 is concentrically positioned relative to, and concentrically inside of, the weather-resistant seam 32 of the flexible connector 20. The two seams 32, 102 and the door 14 lie within the same plane of the flexible end wall 12.

When the flexible connector 20 is not in use, it can be rolled up onto itself, as shown in FIG. 5, and retained in a secure, stored position close against the end wall 12, and held there by suitable hook and loop fasteners, rope ties, and/or other suitable devices. While the flexible connector 20 is in its stored (rolled-up) configuration, a vestibule frame 150 may be placed in front of the door 14. The illustrated frame 150 has two lower, extending arms 152, 154 and three upper, extending arms 156, 158, 160.

Ends of the lower arms 152, 154 are placed on or near the ground 18, near the door 14. Ends of the upper arms 156, 158, 160 are brought near to, or in contact with, the end wall 12. An important advantage of the illustrated configuration is that the flexible connector 20 is located concentrically outside of the vestibule adapter 100, so that the stored connector 20 does not interfere with the placement of the ends of the frame arms 152, 154, 156, 158, 160 inside the vestibule adapter 100 and against, or near to, the end wall 12.

Figure 6:
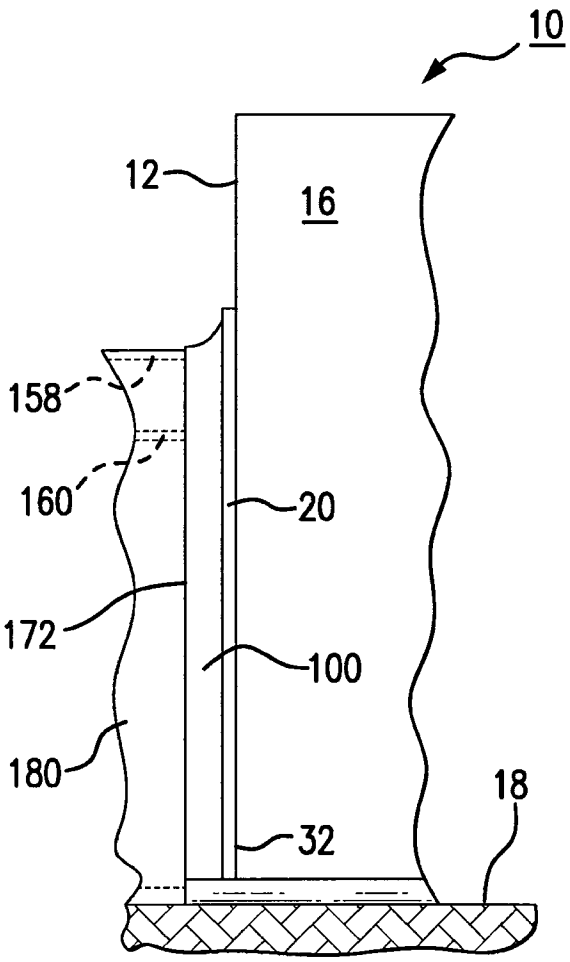
FIG. 6 is a partial side view of the combination of structures illustrated in FIG. 5, with the vestibule installation completed.

If desired, a rope 170 may be threaded through a folded-over forward edge 172 of the vestibule adapter 100. One end of the rope 170 (not visible in the drawings) is connected to the first lower arm 152. The rope 170 is exposed at portions 174, 176, 178 cut out from the forward edge 172 of the vestibule adapter 100, and the other end of the rope 170 (not visible in the drawings) is pulled tight and connected to the other lower arm 154 of the frame 150. The ends of the upper arms 156, 158, 160 are inserted into the cut-out portions 174, 176, 178, with the rope 170 being located underneath each one of the ends of the arms 156, 158, 160. Thus, when the rope 170 is tightened to the rigid frame 150, the vestibule adapter 100 is securely connected to the frame 150. Flexible panels 180 (FIG. 6) are then connected to and/or located over the frame 150 to complete the desired vestibule configuration.

It is understood that various disclosed embodiments are shown and described above to illustrate different possible features of the present invention and varying ways in which the features may be combined. Apart from combining the features of the above embodiments in varying ways, other modifications are also considered to be within the scope of the present invention. The present invention is not intended to be limited to the preferred embodiments described above. The scope of the present invention is intended to be determined according to the claims set out below, and should encompass all alternate and other embodiments that fall literally or equivalently within the scope of the claims. In summary, the present invention is not limited to the structures, methods, and instrumentalities described above and shown in the drawings.

What is claimed and desired to be protected by Letters Patent of the United States is:

1. A portable shelter, comprising:

a wall;

a door located within the wall;

a flexible vestibule adapter connected to the wall, surrounding the door; and a flexible connector connected to the wall, surrounding the door; and wherein the vestibule adapter is concentrically located within the flexible connector;

wherein the shelter has a first, full-storage configuration in which the vestibule adapter is in a first condition stored close to the wall, the flexible connector covers the vestibule adapter, and the flexible connector is stored close to the wall;

wherein the shelter has a second configuration in which (1) the vestibule adapter is in an unfurled condition, unfurled from the first condition of the vestibule adapter, to overlap a vestibule frame and (2) the flexible connector is stored close to the wall; and wherein the unfurled condition of the vestibule adapter is different from the first condition of the vestibule adapter.

2. The structure of claim 1, further comprising a first weather-resistant seam for connecting the vestibule adapter to the wall, and a second weather-resistant seam for connecting the flexible connector to the wall, and wherein the first seam is concentrically located within the second seam.

3. The structure of claim 1, wherein the shelter has a third configuration in which (1) the vestibule adapter is stored close to the wall and (2) the flexible connector is unfurled to connect the shelter to another portable shelter.

4. A multi-use shelter, comprising: the structure of claim 1, wherein the flexible connector is adapted to be connected to a connecting frame for connecting the multi-use shelter end-to-end with another shelter, with the flexible connector being located between the connecting frame and the wall.

5. The multi-use shelter of claim 4, wherein the other shelter is a TEMPER structure.

6. The multi-use shelter of claim 4, further comprising a weather-resistant seam for connecting the flexible connector to the wall.

7. The multi-use shelter of claim 6, further comprising grommets for receiving pins extending upwardly from the connecting frame.

8. A portable structure, comprising:

a wall;

a door located within the wall;

a vestibule connected to the wall of the portable structure and leading into and from the door, and including a vestibule frame;

a flexible vestibule adapter connected to the wall, surrounding the door, for at least partially covering the vestibule frame; and a flexible connector connected to the wall, wherein the vestibule adapter is concentrically located within the flexible connector, and ends of the vestibule frame are located within the vestibule adapter; and wherein the flexible connector is rolled up onto itself and is thereby stored close to the wall.

9. The portable structure of claim 8, wherein the vestibule adapter has a forward edge, and a rope extends through the edge to tighten the vestibule adapter to the frame.

* * * * *